United States Patent [19]

Nielsen

[11] Patent Number: 4,491,329

[45] Date of Patent: Jan. 1, 1985

[54] TETHERBALL GAME

[75] Inventor: Ole K. Nielsen, Copenhagen, Denmark

[73] Assignee: Zimm Zamm AG, Baar, Switzerland

[21] Appl. No.: 526,572

[22] Filed: Aug. 25, 1983

[30] Foreign Application Priority Data

Aug. 26, 1982 [ZA] South Africa ..... 82/6244

[51] Int. Cl.[3] ..... A63B 71/02

[52] U.S. Cl. ..... 273/413

[58] Field of Search ..... 273/413

[56] References Cited

U.S. PATENT DOCUMENTS

| | | | |
|---|---|---|---|
| 3,730,526 | 5/1973 | Litzka | 273/413 |
| 3,829,093 | 8/1974 | Abrams | 273/413 |
| 4,162,790 | 7/1979 | Kelsey | 273/413 |
| 4,188,033 | 2/1980 | Wells | 273/413 |

FOREIGN PATENT DOCUMENTS

| | | | |
|---|---|---|---|
| 1557479 | 12/1979 | United Kingdom | 273/413 |

*Primary Examiner*—William H. Grieb

*Attorney, Agent, or Firm*—Kuhn, Muller and Bazerman

[57] ABSTRACT

The invention is concerned with apparatus for a game of tether ball in which a bolt member is mounted on a pole and a ball is attached to a line which is attached at its other end to a nut member rotatable on the bolt member so that the point of attachment is up or down the bolt member according to the direction of travel of the ball after being struck by a bat, an element is being provided inside the bolt portion which is biased for movement in one direction which has a formation adapted releasably to receive a locking formation which is released in one or the other of the winning positions of the game by passage of the nut past such winning positions.

5 Claims, 2 Drawing Figures

TETHERBALL GAME

FIELD OF THE INVENTION

Figure 1:
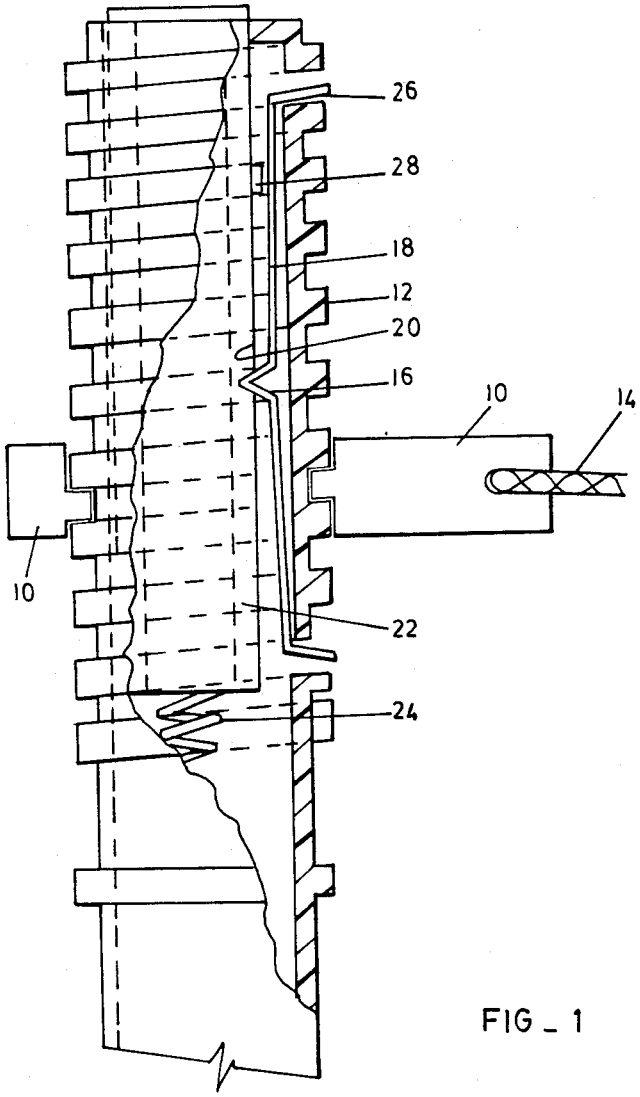

This invention relates to a tether ball game.

BACKGROUND OF THE INVENTION

The traditional game of tether ball has undergone substantial refinements in recent years leading to the well known game comprising a helix mounted on a pole and a ball attached to a line which is attached at its other end slidably with the helix so that the point of attachment moves up or down the helix according to the direction of travel of the ball after being struck by a bat. The game is generally played by two persons, each attempting to hit the ball in opposite directions and the winner is he who manages to cause the point of attachment to travel to its lowermost or highermost position on the helix, depending on the direction in which he is required to strike the ball.

Two main designs of helix have been suggested—one being a spiral, in which case the point of attachment is a ring or the like slidable on the spiral; and the other being a threaded bolt member in which case the point of attachment is a nut element rotatable thereon.

In both cases a problem can arise between players as to whether the line attachment has moved to an end position relative to the helix (which would indicate the end of a particular game) before the player defending that end position has managed to reverse the direction of the ball and therefore the movement of the line attachment relative to that end position.

In the case of the spiral it has been proposed (U.K. Patent No. 1 557 479) to provide bi-modal indicating means which are operable to change mode abruptly on movement of line attachment into either of its two end positions, to provide a perceptible signal. In one example of that invention a sleeve element is provided which is slidable on a pole inside the spiral between a cocked position, triggering formations at either end of the spiral adapted to release the sleeve on contract of the line attachment therewith, whereby the sleeve element is released from its cocked position with the accompanying emission of a signal—for example the visual signal of its rapid movement which may be accompanied by a clicking noise.

As far as the Applicant is aware, no such indicating means have been suggested for the nut-and-bolt type of tether ball game and it is an object of the present invention to provide such means.

THE INVENTION

According to the invention an element is provided inside the bolt portion, the element being biased for movement in one direction and having a formation adapted releasably to receive a locking formation when the element is in a position opposing the bias, the locking formation being in association with members protruding through the bolt portion at or towards either end thereof, these members being adapted to be contacted by the nut portion during its movement therepast, such contact causing release of the locking formation.

In a preferred form of the invention the locking formation and the protruding members are integral, the locking formation taking the form of a projection on a strip of metal polymeric or other material which is bent at either end to constitute the protruding members, the angle being such that movement of either of the protruding members away from the nosing causes a first order lever action which moves the projection outwardly and thereby releases it from its locking position. The strip is preferably of spring steel or other suitable resilient material. The formation on the elements is preferably a slot adapted to receive the projection in releasable locking relationship.

The element inside the bolt is preferably spring loaded either upwardly or downwardly although it will be appreciated that the bias may be provided by gravity. In the preferred form of the invention a compression spring is provided which biases the element upwardly and out of the hollow bolt portion to an extent governed by a stop. Re-cocking of the element takes place merely be depressing the element into the bolt portion until now inwardly biased (by virtue of it being of spring steel) projection enters a slot in the element to constitute the locked position.

EMBODIMENT OF THE INVENTION

An embodiment of the invention is illustrated in the accompanying drawings in which:

FIG. 1 is partially sectional side view of a tether ball game according to the invention (without the pole) in a first position;

and

Figure 2:
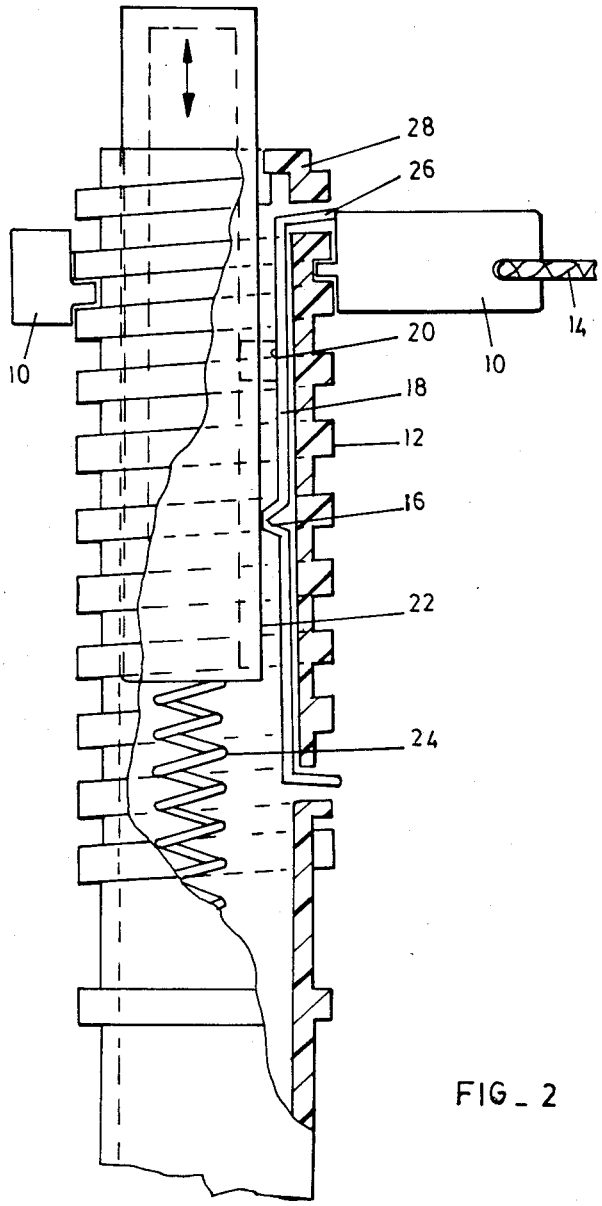

FIG. 2 is a similar view in a second position.

In the drawings a nut portion 10 rides on a bolt portion 12, a ball being attached to the other end (not shown) of the line 14.

In FIG. 1*a* projection 16 on a spring steel strip 18 engages with a slot 20 in an element 22 which is movable inside the bolt portion 12, the element being spring loaded upwardly by means of compression spring 24.

When the nut portion 10 moves, for example to its uppermost position on the helix of the bolt portion 12, it engages a protrusion 26 which is integral with the strip 18. As the protrusion is moved upwardly by the nut portion 10, the projection 16 moves out of the slot 20 and the compression spring causes the element 22 to fly upwardly thereby giving both a visual and a sound signal which is very obvious to the players. Movement of the element 22 upwardly is restricted by suitable stop means 28.

It will be appreciated that a similar action is provided on the underside of the nut portion 10 for urging the protrusion 26 to a position in which the projection 16 moves out of the slot 20.

I claim:

1. Apparatus for playing a tether ball game including a bolt member mounted on a pole, and a ball attached to a line which is attached at its other end to a nut member rotatable on the bolt member so that the point of attachment moves up or down the helix according to the direction of travel of the ball after being struck by the bat, characterised in that an element is provided inside the bolt member, the element being biased for movement in one direction and having a formation adapted releasably to receive a locking formation when the element is in a position opposing the bias, the locking formation being in association with members protruding through the bolt member at or towards either end thereof, these members being adapted to be contacted by the nut member during its movement therepast, such contact causing release of the locking formation.

2. The apparatus of claim 1 characterised in that the locking formation and the protruding members are integral, the locking formation taking the form of a projection on a strip of metallic, polymeric or other material which is bent at either end to constitute the protruding members, the angle being such that movement of either of the protruding members away from the angle causes a first order lever action which moves the projection outwardly and thereby releases from its locking position.

3. The apparatus of claim 2 in which the strip is of spring steel.

4. The apparatus of claim 2 in which the formation on the element is a slot adapted to receive the projection in releasably locking relationship.

5. The apparatus according to claim 1 in which the element inside the bolt is spring loaded in the upward direction.

* * * * *